United States Patent [19]

Bettenhausen

[11] 4,014,257

[45] Mar. 29, 1977

[54] APPARATUS FOR DIE CUTTING INDICIA ON A MULTILAYER TAPE

[75] Inventor: Larry A. Bettenhausen, West Lakeland Township, Washington County, Minn.

[73] Assignee: Minnesota Mining and Manufacturing Company, St. Paul, Minn.

[22] Filed: July 28, 1975

[21] Appl. No.: 599,357

[52] U.S. Cl. ..... 101/26; 101/24; 101/30; 101/272; 83/510; 83/229

[51] Int. Cl.[2] ..... B44B 5/00

[58] Field of Search ..... 101/19, 20, 24, 26, 101/30, 269–274, 128.2, 128.4; 197/1.5, 6.6; 83/1, 510, 229, 226

[56] References Cited

UNITED STATES PATENTS

| | | | |
|---|---|---|---|
| 1,305,778 | 6/1919 | Cushing et al. | 101/269 |
| 3,076,367 | 2/1963 | Leibinger | 83/229 X |
| 3,237,499 | 3/1966 | Lohrand et al. | 83/510 |
| 3,566,736 | 3/1971 | Johnson et al. | 83/510 |
| 3,673,953 | 7/1972 | Massari | 101/19 |
| 3,770,093 | 11/1973 | DeHart et al. | 101/19 X |
| 3,814,015 | 6/1974 | Ozaki et al. | 101/269 |

*Primary Examiner*—Edward M. Coven
*Attorney, Agent, or Firm*—Cruzan Alexander; Donald M. Sell; John C. Barnes

[57] ABSTRACT

Apparatus for supporting a die plate having indicia formed thereon by a raised rib and for forcing a tape into engagement with the raised rib to cut indicia from said tape corresponding to the indicia on the die. The apparatus utilizes a flat platen supporting one side of the die, a roller mounted on a movable frame and spring biased toward the die plate. A tape is guided across the surface of the die plate at an oblique angle to the direction of movement of the roller such that to cut alphabetic or numerical indicia the cutting is generally taking place at spaced points on the surface of the roller and generally no cuts are made along a line defining a portion of the indicia. The apparatus is cycled by an operating lever to move the roller across the surface of the tape under sufficient spring pressure to afford the cutting operation and then the roller is retracted as the operating handle is returned to the normal position. The die plates are formed with recessed edges to automatically adjust the advancement of the tape past the cutting station to properly space the indicia on the tape.

9 Claims, 9 Drawing Figures

APPARATUS FOR DIE CUTTING INDICIA ON A MULTILAYER TAPE

BACKGROUND OF THE INVENTION

1. Field of the Invention

This invention relates to an improved apparatus for cutting indicia on a multilayer tape, and in one aspect to an improved machine which reduces the forces necessary to effect the die cutting operation and suitably guides, supports, and advances a multilayer tape through the cutting station.

2. Description of the Prior Art

Cutting or creasing a web by forcing the same against a narrow raised surface on a plate is known in the art. An example of a die plate for cutting or creasing a web as described is illustrated in U.S. Pat. No. 2,782,851, issued Feb. 26, 1957, to M. E. Gazette. This cutting step illustrated in this patent is achieved by wrapping the die plate around a first roller and feeding the paper sheet to be cut between the die plate and an anvil roller. These rolls are rotated in opposite directions so that when the paper is introduced between the rollers the outline formed on the die plate cuts the paper sheet to form the separate pieces having a similar outline to that formed on the die plate. If creasing of the paper rather than cutting is desired the anvil roller is made from a material sufficiently yielding to prevent the wire from cutting through the paper.

A further system for cutting indicia from a web is illustrated in U.S. Pat. No. 3,673,953, issued July 4, 1972, to B. J. Massari. In this patent there is illustrated the use of a die plate having an indicia formed in a raised rib thereon to cut indicia from a multilayer tape. In the machine the die plate is not wrapped about the surface of one of two opposed rollers but is positioned between the rollers at the nip thereof and is moved with the multilayer web through the nip area between a pair of rollers, one of which supports and guides the tape between the nip and the other forms the anvil roller. In this apparatus to acquire sufficient pressure the rollers must be rigidly mounted and uniformly driven to advance the die plate therebetween as the web is advanced. In this structure it was common to have to make a cut along a line defining an edge of the indicia as the same is moved through the nip. Thus, exact tolerances of the rollers is required to maintain the spacing and sufficient pressure therebetween along the length of the rollers.

Thus, to achieve uniformity and to maintain the pressure uniform during the cutting operation it is preferred that the roller move across the face of the cutting die in such a manner as to cut at spaced points along the die and not to cut along a line. This will reduce the tolerances and the size of the members necessary to accomplish the pressures which are required. Manufacturing tolerances will not be as precise in the equipment.

The type of tape which is adapted to be cut by this machine is disclosed in U.S. Pat. No. 3,558,425, issued Jan. 26, 1971 to B. J. Massari. This patent discloses a three-layer laminated stencil-forming tape having an upper carrier layer adapted to be embossed, an intermediate stencil layer to be cut during embossing of the upper layer, and a lower support layer which can be either cut or uncut during the embossing. The lower surfaces of both the upper carrier and the stencil-forming layer are provided with normally tacky and pressure-sensitive adhesive which not only serves to maintain the integrity of the laminate during processing but also assists in separating the cut indicia from the rest of the stencil layer and subsequently transferring them to a permanent supporting surface. An improved structure for the stencil-forming tapes is disclosed in United States application Ser. No. 591,106, filed June 25, 1975, by J. D. Laperre, and assigned to the assignee of this application and incorporated herein by reference. In this application the tape structure can be subjected to pressures of a cutting die without severing the upper carrier layer while still providing adequate definition of the character defined by the cutting die. The adhesion of the upper layer to the stencil layer significantly exceeds the adhesion of the stencil layer to the support layer thereby permitting the ready removal of the support layer after a sequence of indicia has been die cut from the stencil layer. Because the upper carrier layer maintains its integrity and is not severed, particularly in the direction at right angles to the edges of the tape, it can be employed to position the sequence of indicia in predetermined constant spaced position.

SUMMARY OF THE INVENTION

The present invention provides a hand-operated machine for cutting from a tape sequentially selected indicia for forming a message on the tape. In operation, the operator selects a die plate with the desired indicia and places it in the machine in which tape has been placed along a predetermined guide path. Upon operation of a handle in a reciprocatory manner the indicia on the die is cut into the tape and the die plate is removed and another die plate placed in the machine. The tape is advanced incrementally between die cutting operations to advance the tape a predetermined amount to properly space the indicia along the length of the tape.

The machine comprises a main frame having a longitudinal axis, a guide for the tape is provided on the frame for guiding the tape from a supply roll on a support along a path transverse to the longitudinal axis of the main frame and oblique thereto. A roller is driven in the direction of the longitudinal axis and rotated about an axis normal to the longitudinal axis forcing the tape against the die plate placed between a flat surface area defining a cutting platen and the tape. The path of the tape is at an angle of between 75° and 85° to the longitudinal axis of the machine and preferably at 83°, thus affording opposed contact between the surface of the cutting roller and points spaced along the opposed surface of the die defined by the raised rib on the die plate. Cam and cam follower members are provided and define cam means on the main frame and on the frames supporting the pressure roller such that the pressure roller is forced against the tape during movement of the roller in one direction along the longitudinal axis of the machine and is separated from the tape upon the return motion of the roller with respect to the tape path. Cam means are also provided to shift the cam follower to and from contact with the cam on the main frame at either end of a cycle of the operating handle.

Cutting means are provided for cutting the web and to form a tab to aid in the separation of the various layers of the tape. The cutting member comprises a cutting wheel having two radially and axially spaced coaxial cutting edges, one of which will sever the die-cut portion of the tape from the supply of tape and the other of which will sever one or more layers of the tape without severing the carrier layer. When the cutter is shifted into position to cut the web, cam means are provided for holding the die cutting roller out of contact with the tape to avoid forming unwanted indicia on the tape in the event that a die plate is retained within the machine.

The die plates are preferably formed with ridges outlining the indicia to be cut in the tape. The ridges are preferably formed by coining the metal plate forming the die plate. The die plate is formed with indicia approximately 3 inches in height and each die plate has a tab identifying the indicia formed on the plate and ears which defined the position of the plate in the machine. An edge of the die plate spaced from the registering ears serves as a guide upon operation of the machine to determine the increment the web is to be advanced after the die cutting operation to regulate the advance of the tape to position subsequent indicia on the tape in proper spaced relationship to the preceding indicia. Spaces between words are formed by inserting a spacer plate free of embossed indicia over the platen surface and operating the control handle to provide a space between words.

DESCRIPTION OF THE DRAWING

The present invention will be more fully understood after reading the following detailed description which refers to the accompanying drawing wherein like numerals refer to like parts throughout the several views and wherein.

DETAILED DESCRIPTION OF THE PREFERRED EMBODIMENT

Figure 6:
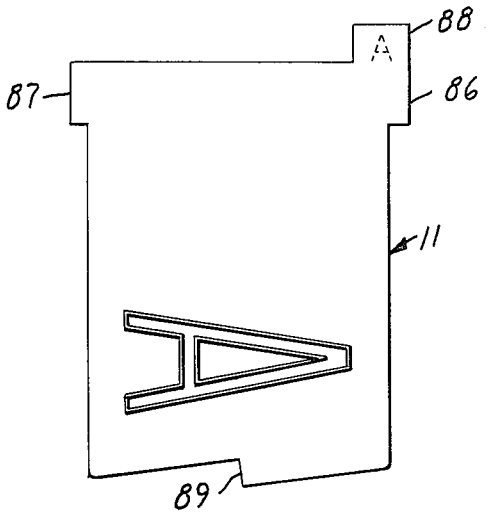
FIGS. 6 and 7 are bottom views of two die plates.
Figure 7:
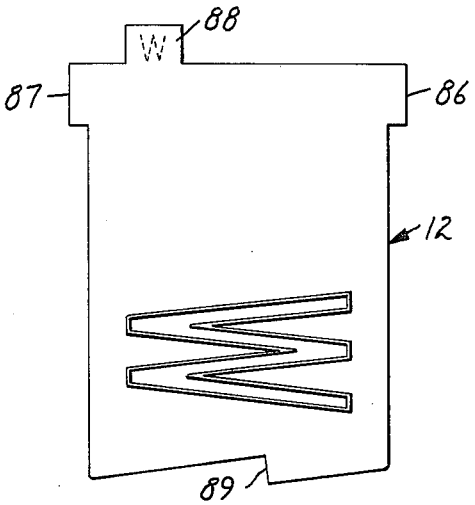
Figure 9:
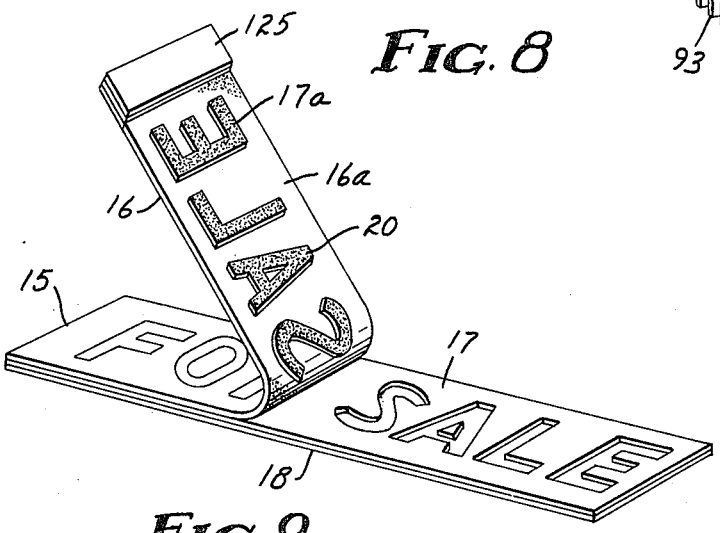
FIG. 9 is a diagramatic view of a multilayer tape cut on the machine disclosed.

The die cutting machine of the present invention is generally designated 10 and die plates having individual indicia outlined thereon and representing a sign, symbol, letter or number are used in conjunction with the machine 10. The die plates are illustrated in FIGS. 6 and 7 and are identified by reference numerals 11 and 12. The machine is adapted to form indicia in a three-layer laminated stencil-forming tape 15 as depicted in FIG. 9 which includes an upper transparent carrier layer 16, an intermediate stencil layer 17 to be cut during the embossing of the upper layer 16, and a lower support layer 18 which can either be cut or uncut and preferably uncut. The surfaces **16*a* and 17*a* of the upper carrier layer 16 and the stencil forming layer 17 are provided with normally tacky and pressure-sensitive adhesive such that a die cut letter such as the letter 20, FIG. 9, may be applied by the pressure-sensitive adhesive to a permanent supporting surface and separated from the carrier layer 16**.

The machine 10 comprises a main frame 22 having a bottom wall 23 and side walls 24 and 25. An upper support plate 26 is secured to the upper ends of the side walls 24 and 25. The forward and rearward edges of the plate 26 are bent upward to make the plate more rigid and an angle beam 27 extends transversely across the support plate 26 to maintain the support plate in a fixed rigid position relative to the main frame 22 and a large flat area on the lower surface of the support plate 26 defines a cutting platen. The large flat surface is positioned between two guide plates 28 and 29 which form part of a guide path for a tape 15 which is supported on a tape support spindle 31 supported on the right side of the machine 10. A cover 30 encloses the upper surface of plate 26 and the tape indexing mechanism which adjusts the drive for a tape feed mechanism.

Guide means, including the plates 28 and 29 and the cutting platen, are provided to guide the tape 15 from a supply roll on a spindle 31 past the cutting station to and between a tape feed roll 32 and spring biased idle roller, past a cutting anvil 34 to a discharge slot 35 formed in a plate 36 secured to the left-hand side of the machine. The guide plates 28 and 29 are disposed transversely to the frame 22 and oblique to a longitudinal axis through the frame 22. Thus the plates 28 and 29 together with other guide members defining a die plate support and tape entry slot form the tape path through the machine and place the tape path at an angle of between about 75° and 85° with respect to the longitudinal axis and preferably at an angle of 83 degrees to the longitudinal axis. The oblique positioning of the tape path will be discussed hereinafter.

A plate 38 is disposed on the upper surface of the bottom wall 23 of the main frame 22. The longitudinal sides of the plate 38 are formed with offset edge portions 39 and 40 which with the bottom wall 23 form therebetween a pair of tracks which guide spaced rollers 41 and 42 affixed to opposite side walls 43 and 44 of a first movable frame generally designated 45. The frame 45 is generally rectangular having a front side wall 46, rear side wall 47, the left side wall 43 and right side wall 44. The rollers 41 are mounted on the left side wall 43 and extend beneath the edge 39 and the rollers 42 are disposed adjacent the opposite ends of the right side wall 44 of the frame 45 and extend beneath the edge 40. The frame 45 is movable longitudinally in a reciprocatory path on the main frame 22 of the machine 10 by an operating handle 49 which is secured to the rear wall 47 and extends rearwardly therefrom, upwardly through the cover 30 and forwardly to a position for easy access by the operator. Alternatively, the frame 45 could be motor driven but the pressures or operation do not necessitate the same.

Pivotally mounted on the movable frame 45 is a second movable frame 50. The frame 50 is pivotally mounted on a transverse shaft 51 which extends between the side walls 43 and 44 of the frame 45. The frame 50 has a pair of transversely spaced side walls 52 and 53 and a bottom wall 54. A shaft 55 extends transversely between the side walls 52 and 53 at one end of the frame opposite the end supported on the shaft 51. A third frame 60 is pivotally mounted on the shaft 51 and supports a cylindrical cutting roller 65. The cutting roller 65 is preferably formed of nylon or another suitable polymeric material with an approximate Rockwell Hardness of 120 on the R scale. The third frame 60 comprises a pair of side walls 66 and 67 and a top wall 69. Side walls 66 and 67 support a fixed shaft 70 which supports the roller 65. A large compression spring 77 is disposed between the bottom wall 54 of the frame 50 and the upper plate 69 of the frame 60 biasing the roller 65 in a position away from the shaft 55 in the frame 50. The spring 77 is retained by a bolt connecting the wall 54 and plate 69 to limit the extent of separation between the two. Movement of the handle 49 will move the first movable frame 45 and the frames 50 and 60 longitudinally of the machine to move the roller 65 across the die cutting station.

Figure 1:
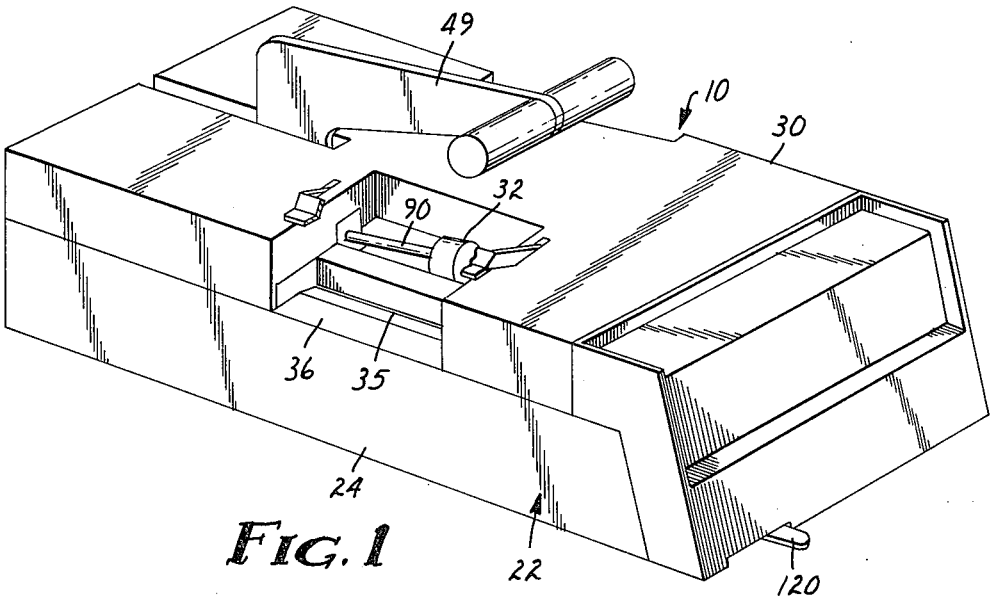
FIG. 1 is a perspective view of a die cutting machine incorporating the present invention and showing the front, top, and left side thereof.
Figure 5:
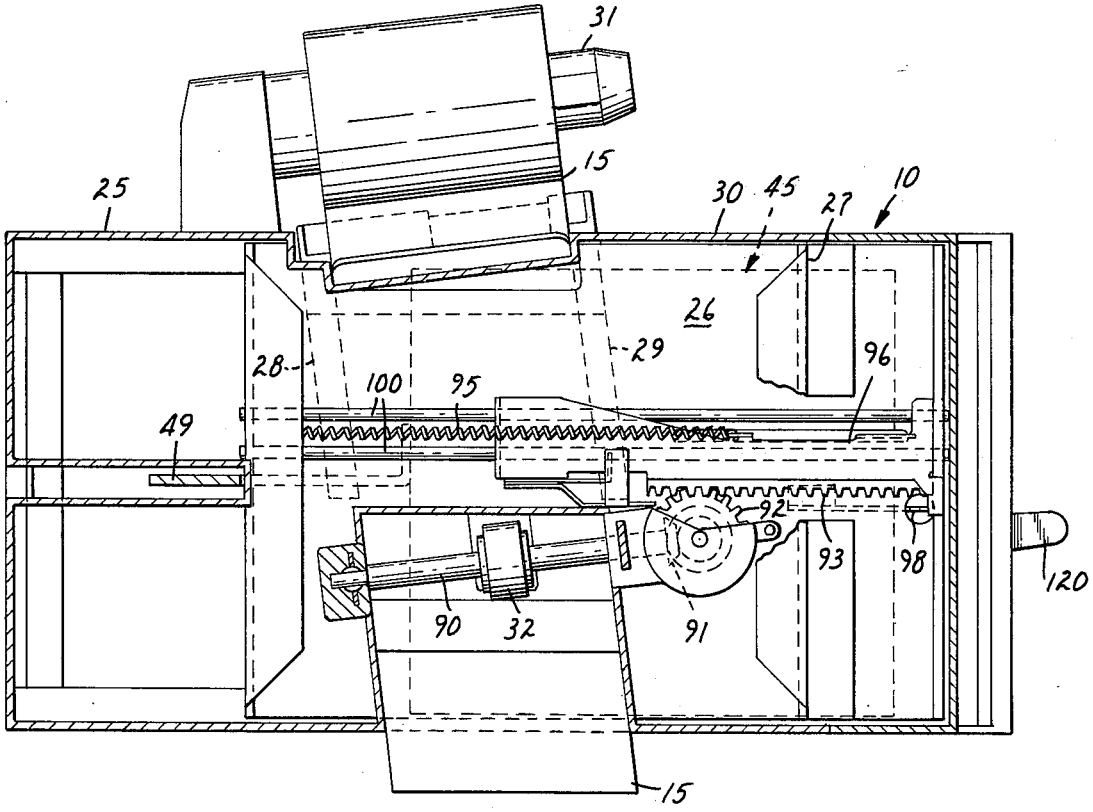
FIG. 5 is a plan view of the machine with the cover removed.
Figure 2:
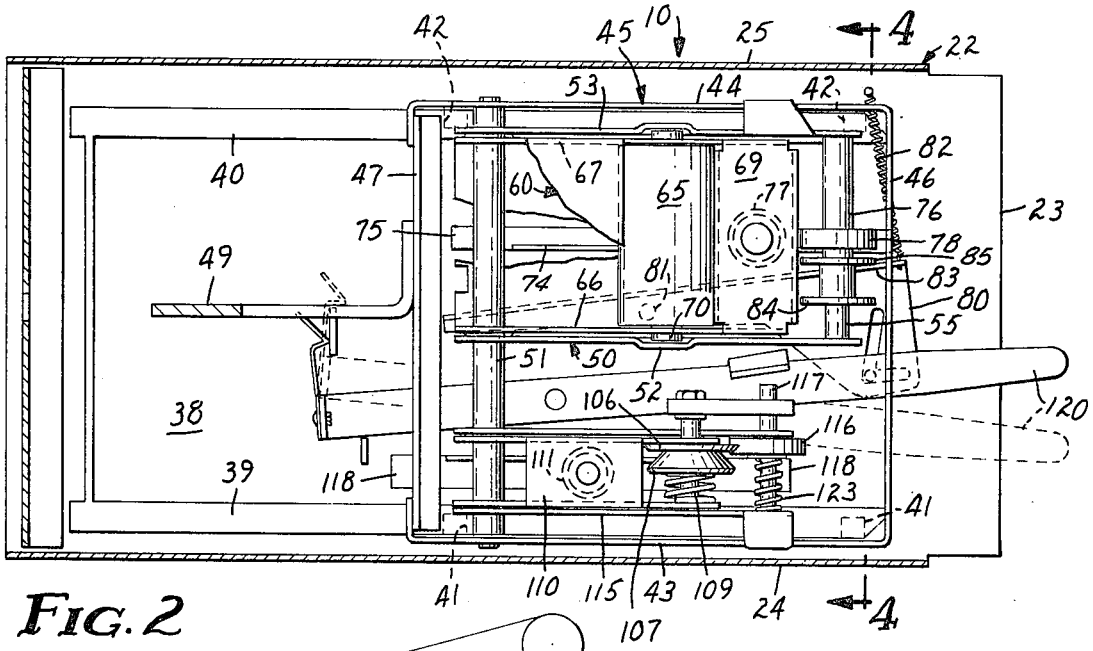
FIG. 2 is a horizontal sectional view taken through the machine.
Figure 3:
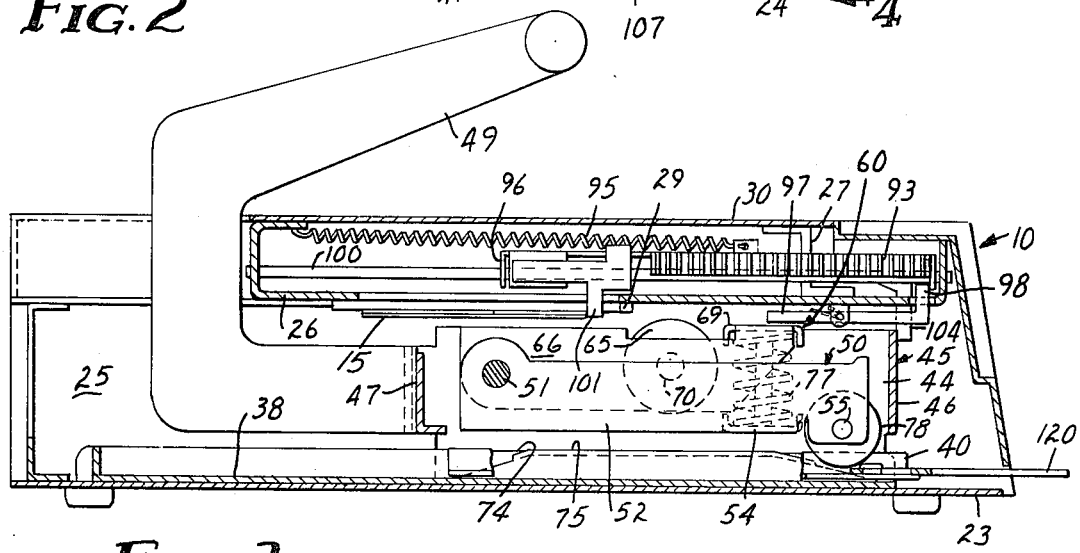
FIG. 3 is a longitudinal sectional view.
Figure 4:
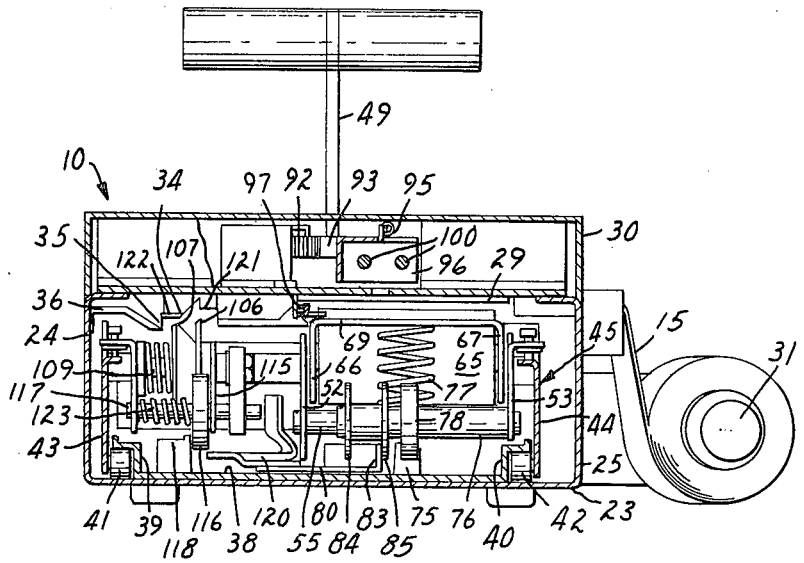
FIG. 4 is a transverse sectional view taken along the line 4—4 of FIG. 2.

Cam means are provided for placing the roller 65 in pressure contact with the tape disposed along the tape path during movement of the movable frames in one direction. The cam means raise the frame 55 relative to frame 45 toward the plate 26 as the frames are moved rearwardly of the machine. To accomplish this a cam 75 is formed longitudinally of the plate 38. A sleeve 76 is disposed on the shaft 55 and is movable axially along the shaft between the side walls 52 and 53. A cam following roller 78 is disposed on the sleeve 76 and is adapted to ride on the cam surface 75 disposed on the plate 38. Thus as the frame 45 moves longitudinally with the cam roller 78 disposed on the cam 75 the roller 65 is urged into engagement with the tape 15 to force the tape 15 towards the die plate positioned below the cutting platen of the upper plate 26 with the formed cutting ridge extending away from the platen. As the frame 45 meets the rear of the main frame 22, cam means are provided for shifting the sleeve 76 and cam roller 78 to the left as shown in FIG. 4, moving the same off of the cam 75 such that the roller 65 is free to traverse the path of the tape without contacting the tape. Upon the return of the frame the cam means automatically then shifts the sleeve 76 to the right aligning the cam roller 78 with the cam 75 such that subsequent operation of the handle 49 will again force the roller into contact with the tape.

The cam means affording the shifting of the sleeve 76 and cam roller 78 comprises a lever 80 which is pivoted intermediate its ends on a pin 81 and biased by a spring 82 to move the front end thereof to the right. The lever 80 has an upstanding flange 83 along one longitudinal edge, which flange is disposed to engage a disc 84 secured to the sleeve 76. As the frame 45 moves rearwardly along the main frame the disc 84 engages the flange 83 causing the lever 80 to pivot against the bias of the spring 82 as the cam roller 78 is retained on the cam 75 by contacting a shoulder 74 disposed along the edge of the cam surface 75. When the cam roller reaches the rear end of the cam surface 75 and moves past the end of the shoulder 74 the spring 82 and flange 83 biases the sleeve 76 toward the left such that upon the return movement the cam wheel 78 will be to the left of the cam track 75. At the opposite end of the cam track the flange 83 contacts a second disc 85 on the sleeve 76 and with the aid of spring 82 biases the cam roller 78 back into aligned position with respect to the cam track 75 by sleeve 76 contacting the side wall 53 of the frame 50. The cam track 75 extends longitudinally a distance sufficient to maintain the roller 65 in a raised position as it traverses the tape path.

Figure 8:
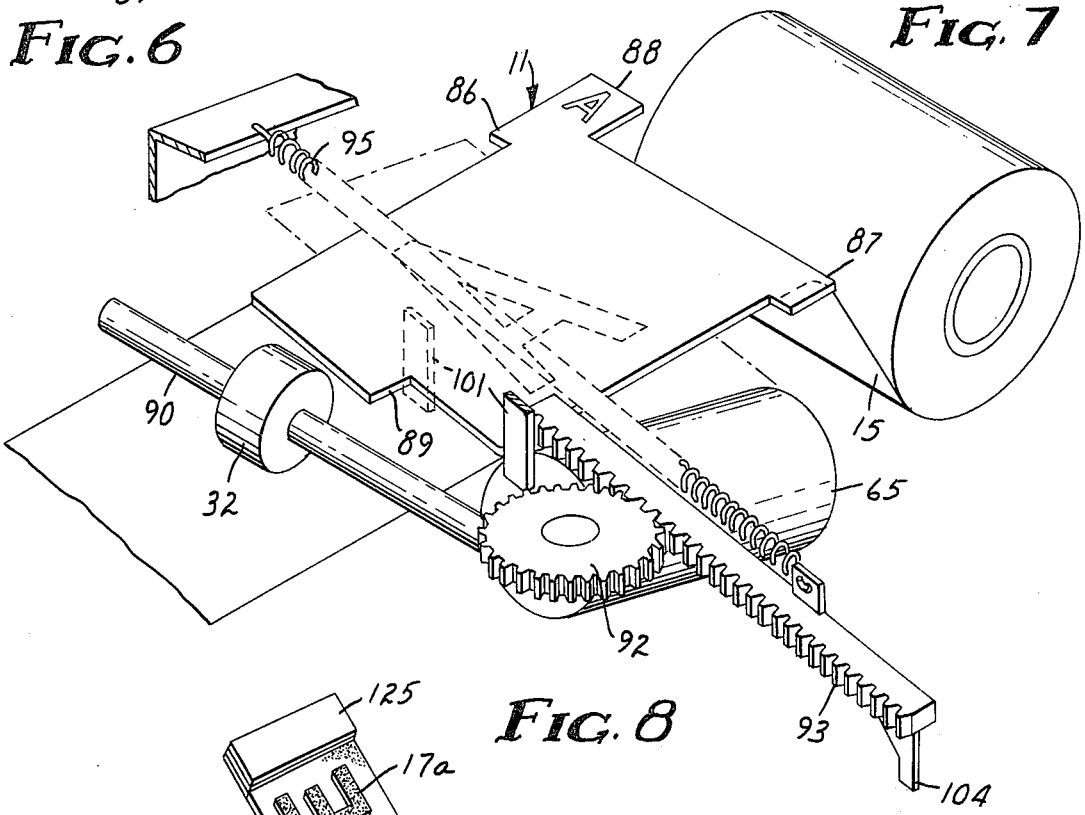
FIG. 8 is a diagramatic view of the die cutting station and tape spring mechanism.

The die plates, such as 11 or 12 are positioned in a slot in a guide plate on the right-hand edge of the machine and inserted under the plate 26 beneath the cutting surface. The plates are inserted with the rib formed thereon and outlining the indicia extending away from the platen and toward the tape 15. The plates are inserted until outwardly extending registering ears 86 and 87 projecting outwardly from one end of the plate are against the edge of the cover 30 adjacent the insert slot. This is best illustrated in FIG. 8. A tab 88 on the plate identifies the indicia thereon. The opposite end of the plate extends into an opening in the plate 26. This edge of the plate is formed with a shoulder 89 at a predetermined spaced distance from the right or a lead edge of the plate. This shoulder 89 defines a stop for the automatic tape indexing mechanism.

The indexing mechanism serves to drive the feed roller 32 through a predetermined rotational increment to advance the tape 15 a predetermined distance along the tape path and past the cutting surface. The feed roller 32 is supported on a rotatable shaft 90 extending normal to the path of the tape 15. At one end of the shaft is a bevel gear 91 engaging a circular gear on the undersurface of a pinion 92. Intermediate the bevel gear 91 and the feed roller 32 is a one-way clutch which permits the feed roller 32 to be driven in only a clockwise direction to advance the tape 15 along the path from the spindle 31 to the discharge slot 35. A rack 93 formed with teeth engaging the pinion 92 is movable by a spring 95 upon a frame 96 being released during a portion of the die cutting cycle and preferably as the main frame approaches the rear of the machine. The frame 60 contacts a depending lug 97 on a latch 98 permitting the frame 96 to move rearward on guide rods 100 extending along the upper surface of the plate 26. The frame 96 is advanced along the rods 100 with the rack 93 freely driving the pinion 92 until a depending lug 101 engages the shoulder 89 on the die plate and stops the frame 96. As the frame 45 returns the rear wall 46 will contact a lug 104 on the frame 96 driving the rack to the front of the machine, causing rotation of the pinion 92 and bevel gear 91 to drive the feed roller 32 through the one-way clutch. The amount of travel of the rack determines the extent to which the tape is advanced along the tape path. This action is illustrated in FIG. 8 showing the lug 101 engaging the shoulder 89 and being secured to the frame 96 and rack 93.

The cutting mechanism of the present machine comprises a pair of rotatable cutting wheels 106 and 107 supported on a fixed shaft 109 in a frame 110 pivotally mounted to the shaft 51. These cutting members 106 and 107 are urged upwardly by means of a spring 111 positioned between the frame 110 and a support frame 115. The frame 115 is in many respects similar to frame 50 and has a transverse shaft 117 supporting a cam follower roller 116 which follows a cam track 118 similar to the cam track 75. In normal operation of the machine to cause the cutting of the indicia the cam follower 116 for the cutter wheels 106 and 107 is guided away from the cam track 118. In order to enable the cutting mechanism it is necessary to shift a pivoted lever 120 which is connected by a pin riding in a slot in the lever 80 to shift the lever 80 such that flange 83 engages the disc 84 moving the cam following roller 78 away from cam track 75 and shifts the cam follower roller 116 of the cutting mechanism into aligned position with the cam surface 118 against the bias of a spring 123 such that the cutting wheels 106 and 107 are lifted to a position to be in opposed cutting relationship with the cooperating cutting edge 121 and surface 122, respectively on the cutting anvil 34 upon subsequent movement of the frame 34. The cutting wheels are axially and radially spaced on the shaft such that the cutting wheel 106 and cutting edge 121 will completely sever the tape 15 transversely upon movement of the frame 45 and the second cutting wheel 107 will cut against the anvil surface 122 two of the layers of the tape to form a tab 125 which aids in the subsequent separation of the layers of the tape and to lift the cut letters from the stencil forming layer.

Having thus described the present invention with respect to a preferred embodiment it will be appreciated that changes may be made therein without departing from the spirit or scope of this invention.

I claim:

1. A machine for cutting one layer of a multilayer tape to form indicia from said one layer for forming messages, said indicia corresponding to indicia formed on one or more die plates having a raised cutting ridge formed thereon to define the outline of the indicia, said machine comprising:

a main frame having a longitudinal axis, tape guide means for guiding a said tape along a path transversely across said main frame and oblique to said longitudinal axis, said guide means including a plate supported rigidly on said main frame and having a flat surface area defining a cutting platen, means for receiving a die plate adjacent said cutting platen with the cutting ridge extending away from the cutting platen, feed means for incrementally advancing said tape along said guide means and past said cutting platen, a first movable frame supported for movement along said main frame parallel to said longitudinal axis, a second movable frame pivotally mounted on said first movable frame and movable therewith, a roller rotatably mounted on said second movable frame and supported, with its axis transverse to said longitudinal axis, by spring means to urge said roller toward said cutting platen, cam means on said main frame and said second frame for urging said second frame toward said cutting platen and said roller into pressure contact toward said cutting platen when said first movable frame is moved in a first direction along said longitudinal axis and across said path of a said tape and to retract said second frame and said roller relative to said cutting platen when said first frame is moved in the opposite direction.

2. A machine according to claim 1 wherein said cam means includes a rib extending toward said cutting platen and parallel to said longitudinal axis and a rotatable cam follower supported on said second frame to ride along said rib to move said roller accordingly toward said cutting platen.

3. A machine according to claim 2 wherein said cam means further includes a cam member for urging said cam follower transversely away from said rib, said cam member including a lever pivoted to the main frame on an axis normal to said longitudinal axis and having flange means extending toward said platen, a disc movable with said cam follower and engageable with said flange means for shifting said cam follower laterally at opposite ends of said rib.

4. A machine according to claim 3 wherein said path is disposed at an angle of between 75 and 85 degrees to said longitudinal axis and said axis of said roller is substantially perpendicular to said longitudinal axis.

5. A machine according to claim 1 wherein said path is disposed at an angle of between 75 and 85 degrees to said longitudinal axis and said axis of said roller is substantially perpendicular to said longitudinal axis.

6. A machine according to claim 1 wherein drive means are provided for actuating said feed means as said first frame is moved in said opposite direction, said drive means including a drive member movable into contact with a stop formed on one end of a said die plate and movable away from said stop upon movement of said first frame in said opposite direction, and means connecting said drive member to said feed means.

7. A machine according to claim 1 wherein means for cutting said tape are disposed adjacent said cutting platen, said cutting means comprising a third movable frame supported on said first movable frame and movable therewith, a cutting anvil supported along said guide means in spaced relationship to said cutting platen and extending transversely of said tape path, a cutting wheel supported on said third movable frame and biased toward said cutting anvil, and cam means for urging said third movable frame toward said cutting anvil when said first movable frame is moved in said first direction.

8. A machine according to claim 1 wherein said roller is supported on a third frame movable with respect to said second movable frame and biased by said spring means, said spring means comprising a compression spring disposed between said second movable frame and said third frame.

9. In a machine for die cutting indicia from one layer of a multilayer tape for forming messages, said machine comprising:

a die plate comprising a generally flat plate having a raised rib outlining indicia on one surface, said indicia being positioned between opposite edges of said plate, a pair of ears extending outward one from each of said edges, and a shoulder formed at one end of said plate between said edges, a support for said plate including guide means engageable with said ears to align said indicia on said support, means for forcing said tape into contact with said raised rib to cut into said tape indicia corresponding to said raised rib, feed means for feeding a said tape past said support and across said raised rib, drive means for said feed means, and means for controlling the drive means to drive a predetermined amount of tape by said feed means, said means comprising a rack, means mounting said rack for movement from a first position into contact with said shoulder, means for returning said rack to said first position, and means responsive to movement of said rack to said first position to transfer a driving force to said feed means during said return movement.

* * * * *